US005153659A

United States Patent [19]

Maiefski et al.

[11] Patent Number: 5,153,659

[45] Date of Patent: Oct. 6, 1992

[54] MULTICOLOR ELECTROPHOTOGRAPHIC DEVELOPMENT SYSTEM WITH DETACHABLE LIQUID DEVELOPING DEVICES ROTATABLY MOUNTED

[75] Inventors: Romaine R. Maiefski; Jon S. Guy, both of Carlsbad; David H. Feather, San Diego, all of Calif.

[73] Assignee: ColoRep, Inc., Carlsbad, Calif.

[21] Appl. No.: 612,791

[22] Filed: Nov. 14, 1990

[51] Int. Cl.[5] ..... G03G 15/10

[52] U.S. Cl. ..... 355/256; 118/645; 118/659; 222/105; 222/318; 222/DIG. 1; 355/245; 355/260; 355/326

[58] Field of Search ..... 118/645, 659, 660; 355/245, 256, 260, 326, 327, 328; 222/DIG. 1, 92, 94, 105, 145, 318; 416/223 R

[56] References Cited

U.S. PATENT DOCUMENTS

| | | | |
|---|---|---|---|
| 3,334,613 | 8/1967 | Young | 355/256 |
| 3,985,435 | 10/1976 | Suzuki et al. | 355/327 |
| 4,443,092 | 4/1984 | Eisein et al. | 335/260 X |
| 4,452,174 | 6/1984 | Fedder | 355/245 X |
| 4,622,916 | 11/1986 | Tanaka et al. | 118/645 X |
| 4,671,207 | 6/1987 | Hilbert | 118/657 |
| 4,728,987 | 3/1988 | Diola et al. | 118/645 X |
| 4,792,825 | 12/1988 | Saito et al. | 355/256 X |
| 4,800,839 | 1/1989 | Ariyama et al. | 118/645 X |
| 4,931,838 | 6/1990 | Ban et al. | 355/260 |
| 4,947,215 | 8/1990 | Chuang | 355/326 X |

FOREIGN PATENT DOCUMENTS 0184373 10/1984 Japan .

*Primary Examiner*—A. T. Grimley
*Assistant Examiner*—J. E. Barlow, Jr.
*Attorney, Agent, or Firm*—Brumbaugh, Graves, Donohue & Raymond

[57] ABSTRACT

A liquid electrophotographic development system has a plurality of removable cartridges mounted on a rotatable support for selective engagement with an electrophotographic member to be developed. Each cartridge has a liquid developer reservoir and a flexible toner concentrate container from which concentrate is supplied to the developer in the reservoir as needed. A fluted roll pumps developer in a uniform manner from the reservoir to the electrophotographic member. After depletion of the toner concentrate and developer, any developer remaining in the cartridge can be pumped into the flexible container to prevent spillage on disposal of the cartridge. The cartridge housing has only one opening and minimum-size passages between the reservoir and the opening to inhibit evaporation of developer liquid.

28 Claims, 2 Drawing Sheets

MULTICOLOR ELECTROPHOTOGRAPHIC DEVELOPMENT SYSTEM WITH DETACHABLE LIQUID DEVELOPING DEVICES ROTATABLY MOUNTED

BACKGROUND OF THE INVENTION

This invention relates to liquid development systems for electrophotography and, more particularly, to a new and improved liquid development system utilizing self-contained cartridges for handling liquid electrophotographic developers.

Conventional liquid developer systems have several inherent problems. As liquid developer is used, it must be replenished, but replenishment by the operator involves possible spillage of liquid developer in the interior of the electrophotographic system or the surrounding office environment. Moreover, circulation of liquid developer from a reservoir within the apparatus to the electrophotographic material being developed is often accomplished by a central pump which distributes the developer to the electrophotographic surface through a manifold, creating nonuniform flow with unequal velocity and pressure distribution, resulting in observable print defects.

Furthermore, as liquid developer is used, the toner concentration in the developer decreases, resulting in decreased density of the developed images. Another difficulty with conventional liquid developer systems results from evaporation of liquid when the developer system is not in use, causing plating-out, leaving a dry toner deposit on surfaces of the developer system, and also depleting the liquid content of the developer in the system. Such depletion causes toner particles to aggregate, resulting in print defects.

Moreover, where liquid toner has been supplied in cartridges for use in electrophotographic systems, cartridge replacement has resulted in spillage of liquid remaining in the cartridge and also requires disposal of that liquid. Furthermore, evaporation of the developer liquid during use in conventional cartridge systems not only depletes the volume of the developer and shortens the life of the cartridge, but also requires complex filter arrangements to trap all of the evaporated developer to be trapped within the electrophotographic apparatus to avoid contaminating the surrounding atmosphere.

SUMMARY OF THE INVENTION

Accordingly, it is an object of the present invention to provide a new and improved liquid electrophotographic development system and a cartridge for use therewith which overcomes the above-mentioned disadvantages of the prior art.

Another object of the invention is to provide a liquid electrophotographic development cartridge which may be removed from an electrophotographic apparatus and disposed of without spillage or removal of developer liquid.

A further object of the invention is to provide a liquid developer system especially adapted to assure uniform application of developer to an electrophotographic member.

These and other objects of the invention are attained by providing a liquid development system for an electrophotographic apparatus having a cartridge which includes a flexible enclosure for toner concentrate to be metered into the developer in the cartridge as required during use. The cartridge has a single opening of limited area for access to the electrophotographic member to be processed and, prior to installation in the electrophotographic system, the opening is covered with a liquid-tight seal. When the toner concentrate has been depleted after use, the developer liquid in the reservoir is pumped into the flexible container, thereby preventing spillage of liquid when the cartridge is removed. Moreover, passages to the exterior of the cartridge are provided with liquid traps such as inwardly directed lips to prevent any liquid residue in the cartridge from passing out of the opening.

According to another aspect of the invention, liquid developer is pumped from a reservoir within the cartridge to a development roll adjacent to the surface of the electrophotographic member being developed by a rotary pump comprising a fluted cylinder having vanes with a length corresponding substantially to the width of the electrophotographic member being processed which directs developer to a supply duct of corresponding width, thereby assuring uniform application of developer to the member. In one embodiment, the developer is metered onto the electrophotographic member by a developer roll having a surface which moves in the same direction as the adjacent electrophotographic member and any remaining developer is removed thereafter by a wiping roll having an adjacent surface which moves in the reverse direction with respect to the motion of the electrophotographic member. According to another embodiment, a single development roll having a surface moving in the reverse direction to the motion of the electrophotographic member is provided. To avoid the necessity for an opening in the cartridge wall, the developer pump is driven by a magnetic coupling through the cartridge wall.

According to still another aspect of the invention, reduced loss of developer liquid during operation of the system is assured by providing openings in the developer flow path between the developer reservoir and the atmosphere which have the minimum area necessary to provide adequate developer flow rates during operation, thereby minimizing evaporation of developer into the atmosphere. Moreover, to prevent plate-out of toner from the developer as a result of evaporation, horizontal or substantially horizontal surfaces within the cartridge are eliminated.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
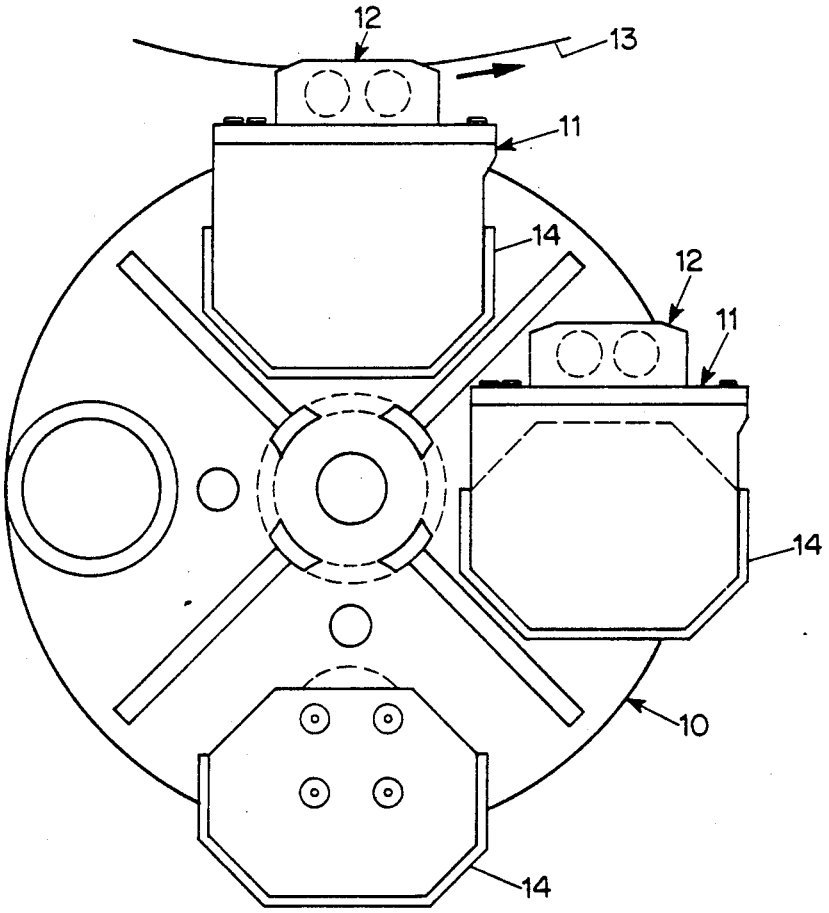
FIG. 1 is a schematic side view of a cartridge support arrangement for a multicolor liquid development system in which each of several development cartridges may be moved selectively into position for sequential development of images on an electrophotographic member.

Referring first to the typical embodiment of the invention shown in FIG. 1, a four-color liquid development system for use in an electrophotographic apparatus has a rotary development cartridge support 10 for supporting and moving four development cartridges 11, only two of which are shown in FIG. 1. The four cartridges contain, for example, yellow, magenta, cyan and black liquid developers, respectively.

Each cartridge 11 has an opening 12 in its top wall and, when moved into the uppermost of the four cartridge positions shown in FIG. 1, the cartridge is in an operative position with respect to an electrophotographic member 13 which is moved during development in the direction of the arrow within the electrophotographic device past the cartridge opening 12. Each of the development cartridges is removably supported on a tray 14 and, for convenience in illustration, the tray for supporting the fourth cartridge used in the system is not shown in FIG. 1.

Prior to installation in the system, each cartridge 11 has a removable, liquid-tight seal (not shown) covering the opening 12 to prevent leakage of developer liquid contained in the reservoir 28 during storage and shipping. To avoid staining of the operator or the environment by the developer liquid on the inside of the seal when it is removed, untoned developer liquid is supplied in the cartridge when shipped and toner is added from an internal supply after installation. Moreover, to avoid the necessity for an opening in the lower portion of the cartridge housing, a magnetic drive arrangement is provided to drive the developer pump within the cartridge by a magnetic coupling through the cartridge wall adjacent to the support plate 10.

Figure 2:
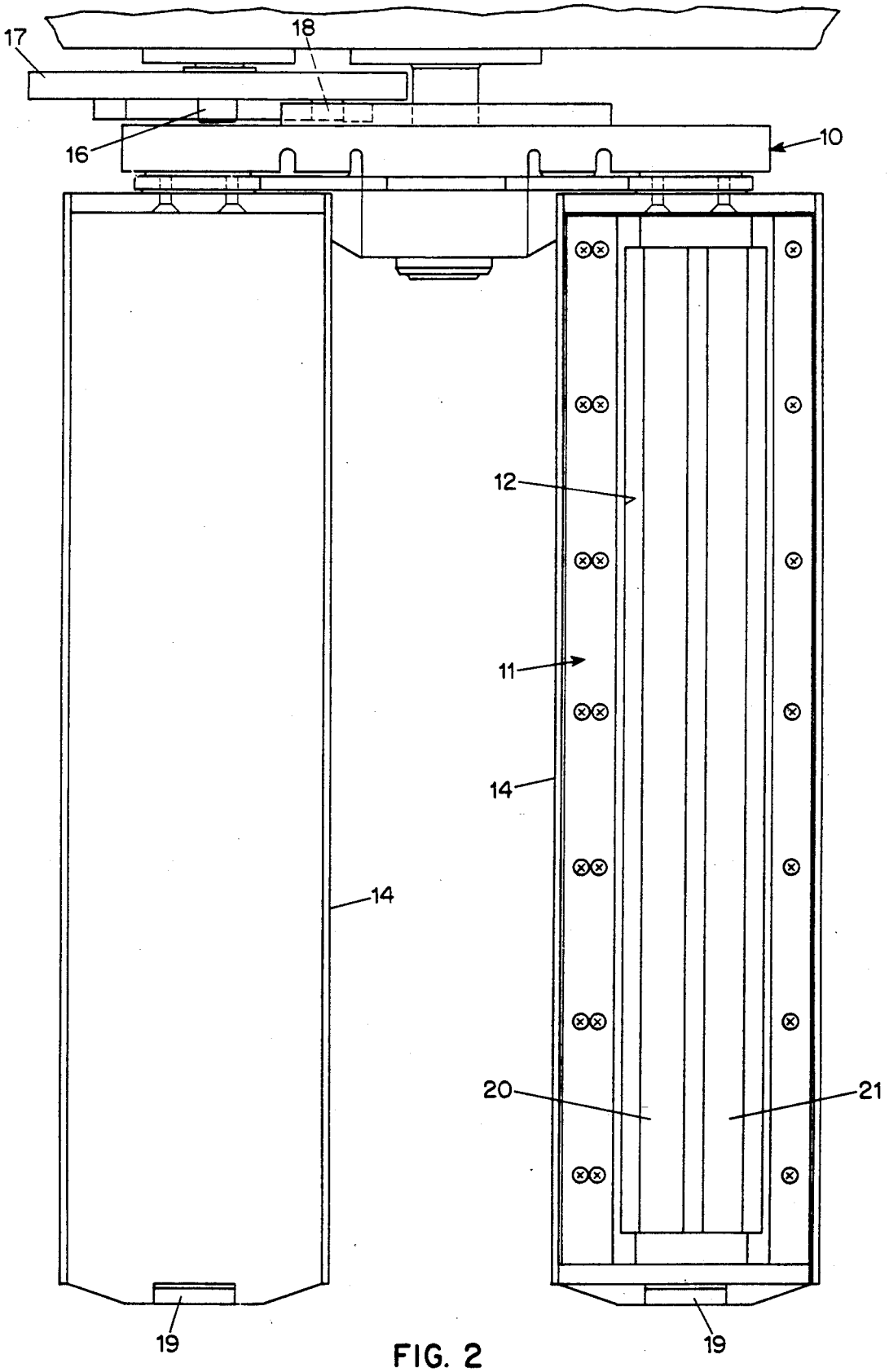
FIG. 2 is a schematic top view of the developer system shown in FIG. 1 with two of the cartridge support trays removed for convenience in illustration.

In the top view shown in FIG. 2, only two trays 14 and only one cartridge 11 are illustrated for convenience, but it will be understood that in a four-color system of the type shown in FIG. 1 two further trays and corresponding cartridges are provided at the additional positions indicated in FIG. 1. In order to move the cartridges selectively into the operative position, which is the uppermost position shown in FIG. 1, the cartridge support 10 is driven by a Geneva drive system in which a drive pin 16 on a drive wheel 17 enters a slot 18 on the support plate 10 as the drive wheel 17 rotates to turn the support plate 10 by one-quarter of a rotation.

As best seen in FIG. 2, each of the development cartridges 11 is retained in the corresponding tray 14 by a releasable latch 19. At the top of the cartridge 11, there are two rolls, a development roll 20 and a wiper roll 21, disposed within the opening 12, each extending substantially the entire length of the cartridge. The development roll 20 is arranged to meter liquid developer onto the electrophotographic member 13 and the wiper roll 21 is positioned to remove any remaining liquid developer from the member 13 after development of the image thereon.

Figure 3:
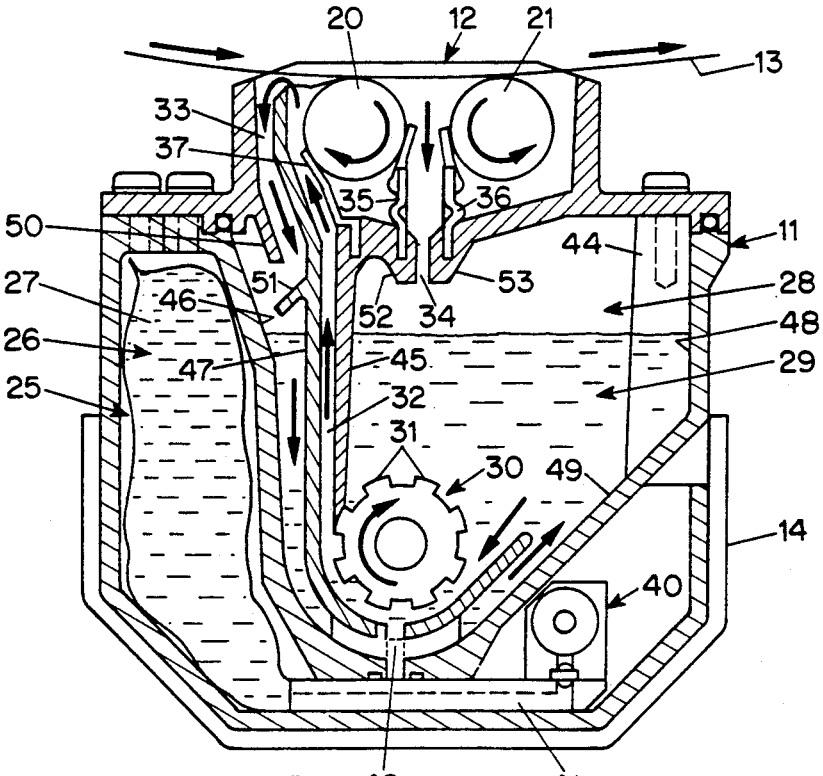
FIG. 3 is an enlarged schematic cross-sectional view illustrating the interior structure and developer flow paths within a representative liquid development cartridge in accordance with the invention.

As shown in the enlarged sectional view of a representative cartridge according to the invention illustrated in FIG. 3, the cartridge 11 includes a compartment 25 on the lefthand side containing a flexible pouch 26 which is filled with toner concentrate 27 and a compartment 28 on the righthand side constituting a reservoir for liquid developer 29. Following installation of a fresh cartridge, toner concentrate is metered by a pump 40 into the clear developer liquid in the reservoir 28 to provide the proper toner concentration.

As noted above in connection with FIG. 1, an electrophotographic member 13, such as a flexible support having a zinc oxide photoreceptor on the lower surface as viewed in FIG. 3, is moved in closely-spaced relation to the two rolls 20 and 21 in the opening 12. In order to direct liquid developer from the reservoir 28 to the development roll 20 and the surface of the electrophotographic member 13 in accordance with the invention, a fluted roll 30, having a series of spaced peripheral vanes 31 extending longitudinally on its surface, is mounted at the bottom of the reservoir 28 within the cartridge 11 and extends substantially the entire length of the rolls 20 and 21. By rotation of the fluted roll 30 in the direction indicated by the arrow in FIG. 3, liquid developer is pumped upwardly through a supply duct 32 to the region adjacent to the developer roll 20 so that the surface of the applicator roll 20 carries the developer against the lower surface of the electrophotographic member 13. Since the developer drive roll 30 has a uniform pumping action along its length and the supply duct 32 has a corresponding width and uniform size, the supply of developer to the electrophotographic member is uniform across its width, thereby avoiding development irregularities.

Excess developer from the upper end of the supply duct 32 falls back into the reservoir through a return duct 33 and is directed back into the reservoir 28 as indicated by the arrows therein. Following development of the image on the electrophotographic member 13, any excess developer adhering to that surface is removed by the wiper roll 21 and delivered back to the reservoir through another duct 34 as indicated by the arrow therein. As the developer roll 20 and the wiper roll 21 rotate in the directions indicated by the arrow, any developer remaining on the surfaces of those rolls is removed and directed to the duct 34 by flexible wiper blades 35 and 36, respectively. Similarly, a flexible wiper blade 37 prevents developer at the upper end of the duct 32 from leaking back into the reservoir past the surface of the roll 20.

During continued development of images on the electrophotographic member 13, toner particles in the developer 29 are removed by deposition on the surface of the electrophotographic member. As a result, the toner concentration in the developer is decreased, leading to a reduction of the maximum image density. In response to detection of such image density reduction by a detector (not shown) in a conventional manner, replenisher, consisting of concentrated toner in the flexible container 26, is metered by the pump 40 from a duct 41 leading from the lower end of the container 26 to a supply duct 42 at the bottom of the reservoir 28, where it is immediately mixed with the developer by rotation of the fluted developer drive roll 30.

As shown in FIG. 3, the developer reservoir 28 has interior walls 44, 45, 46, 47, 48 and 49 which are vertical or more nearly vertical than horizontal. Consequently, as the liquid in the reservoir is depleted, any developer on the walls flows downwardly to join the remaining developer 29 in the reservoir 28 rather than evaporating and plating-out dry toner, as would occur if left on horizontal or nearly horizontal surfaces. Thus, no removal of toner from the developer results by plating-out as a result of a decrease in the liquid level of the reservoir. In addition, the cross-sectional area of the only ducts 32, 33 and 34 which communicate between the reservoir and the atmosphere is the minimum required to permit developer to flow through the system, thereby substantially reducing evaporation of developer from the reservoir to the atmosphere. With this arrangement, the content of vaporized liquid from the developer within the electrophotographic apparatus is reduced substantially. This decreases the complexity of any filtering arrangement between the apparatus and the environment.

After the cartridge 11 has been used to the extent that the toner concentrate 27 is depleted and the level of the developer in the reservoir 28 is reduced, the cartridge is prepared for disposal by reversing the direction of pumping action of the pump 40 to cause all of the remaining developer 29 in the developer reservoir 28 to be pumped from the reservoir back into the flexible container 26 where it is retained without permitting flow back into the reservoir. The cartridge 11 may then be removed from the tray 14 and disposed of without sealing the opening 12 at the top of the cartridge. Any minor residue of liquid remaining in the reservoir will be prevented from passing out of the duct 33 by inwardly-directed lips 50 and 51 and out of the duct 34 by inwardly-directed lips 52 and 53. Consequently, the cartridge can be disposed of without requiring special precautions to be taken to prevent any remaining liquid from escaping through the opening 12.

In an alternative embodiment (not shown), the wiper roll 21 is eliminated and the developer roll 20 is used as both an applicator and wiper roll by rotating it in the opposite direction with respect to the motion of the electrophotographic member 13. In this case, the size of the opening 12 can be reduced.

Although the invention has been described herein with reference to specific embodiments, many modifications and variations therein will readily occur to those skilled in the art. Accordingly, all such variations and modifications are included within the intended scope of the invention.

We claim:

1. A liquid electrophotographic development system comprising support means for supporting a plurality of removable cartridges, support drive means for selectively positioning any of the plurality of cartridges adjacent to an electrophotographic member to be developed, means forming an elongated opening in each of the cartridges to permit application of liquid developer from a reservoir therein to the surface of an electrophotographic member, developer roll means adjacent to the elongated opening, pump means in each cartridge for pumping liquid developer from the reservoir to the developer roll means, and supply duct means in each cartridge extending between the pump means and the developer roll means adjacent to the elongated opening and having throughout a width in the direction of the elongated opening which is at least substantially equal to the width of the electrophotographic member to be developed to assure substantially uniform application of liquid developer thereto.

2. A liquid electrophotographic development system according to claim 1 wherein each cartridge contains a rotatable pump member and including magnetic drive means for driving the rotatable pump member form the exterior of the cartridge by magnetic coupling through a wall of the cartridge.

3. A liquid electrophotographic development system according to claim 1 comprising means for moving one surface of an electrophotographic member adjacent to the developer roll means for development of an electrophotographic image thereon.

4. A liquid electrophotographic development system according to claim 3 including means for moving the surface of the developer roll means in the same direction as the adjacent surface of the electrophotographic member and including wiper roll means spaced from the developer roll means in the direction of motion of the electrophotographic member and means for moving the surface of the wiper roll means in the direction opposite to the direction of motion of the electrophotographic means for removing developer from the adjacent surface of the electrophotographic member.

5. A liquid electrophotographic development system according to claim 1 wherein the electrophotographic member has a photoreceptor surface comprising zinc oxide.

6. A liquid electrophotographic development system according to claim 1 wherein each cartridge contains a different color developer.

7. A liquid electrophotographic development system according to claim 6 including four cartridges containing, respectively, yellow, magenta, cyan and black liquid developers.

8. A liquid electrophotographic development system according to claim 1 wherein each cartridge comprises developer pump means for pumping developer from the reservoir means through the supply duct means to the electrophotographic member comprising a roll extending in a direction transverse to the direction of motion of the electrophotographic member and having a fluted surface adjacent to the duct means, and drive means for rotating the fluted roll in a direction to pump developer from the reservoir means into the duct means.

9. A liquid electrophotographic development system according to claim 1 wherein each cartridge includes flexible container means for holding toner concentrate and toner concentrate pump means for supplying toner concentrate to the developer in the cartridge.

10. A liquid electrophotographic development system comprising support means for supporting a plurality of removable cartridges, support drive means for selectively positioning any of the plurality of cartridges adjacent to an electrophotographic member to be developed, and means forming an elongated opening in each of the cartridges to permit application of liquid developer from reservoir means therein to the surface of an electrophotographic member, wherein each cartridge includes flexible container means for holding toner concentrate and toner concentrate pump means for supplying toner concentrate to the developer in the cartridge and wherein the toner concentrate pump means is adapted to pump liquid developer remaining in the reservoir means into the flexible container means and retain the liquid developer therein upon termination of use of the cartridge.

11. A liquid electrophotographic development system according to claim 1 wherein the reservoir means in each cartridge has side walls which, in the operative position of the cartridge, are more nearly vertical than horizontal.

12. A cartridge for use in a liquid electrophotographic development system comprising elongated housing means having an elongated opening in one wall for access to an electrophotographic member to be developed, developer roll means positioned in the housing adjacent to the elongated opening to control application of liquid developer to an electrophotographic member, liquid developer reservoir means within the housing, supply duct means for conducting liquid developer from the reservoir means to a location adjacent to the developer roll means, and developer pump means for transferring liquid developer from the means to the supply duct means, the supply duct means having a width between the developer pump means and the developer roll means which is at least substantially equal to the width of the electrophotographic member to be developed.

13. A cartridge according to claim 12 wherein the developer pump means comprises fluted roll means extending longitudinally within the housing adjacent to the supply duct means and rotatable in the direction to pump developer from the reservoir means into the duct means and having a length substantially equal to the width of the supply duct means.

14. A cartridge according to claim 12 wherein the reservoir means includes side walls which are more nearly vertical than horizontal to prevent plating-out of toner from the liquid developer therein.

15. A cartridge comprising elongated housing means having an elongated opening in one wall for access to an electrophotographic member to be developed, developer roll means positioned in the housing adjacent to the elongated opening to control application of liquid developer to an electrophotographic member, liquid developer reservoir means within the housing, duct means for conducting liquid developer from the reservoir means to a location adjacent to the developer roll means, and developer pump means for transferring liquid developer from the reservoir means to the duct means, including flexible container means containing toner concentrate and toner concentrate pump means for supplying toner concentrate from the flexible container means to the developer in the reservoir means and for transferring any remaining developer from the reservoir means into the flexible container means upon completion of use of the cartridge.

16. A cartridge according to claim 12 including drive means for moving the adjacent surface of the developer roll means in the same direction as the motion of the electrophotographic member during development and including wiper roll means spaced from the developer roll means in the direction of motion of the electrophotographic member and drive means for moving the adjacent surface of the wiper roll means in the direction opposite to the direction of motion of the electrophotographic member.

17. A cartridge according to claim 12 including first return duct means for directing developer from the region of the opening adjacent to the electrophotographic member back to the reservoir means wherein the supply duct means and the return duct means have the minimum dimensions necessary to assure adequate flow of developer to the electrophotographic member.

18. A cartridge according to claim 17 including wiper roll means spaced from the developer roll means in the direction of motion of the electrophotographic member and drive means for moving the adjacent surface of the wiper roll means in the direction opposite to the direction of motion of the electrophotographic member, and second return duct means disposed between the developer roll means and the wiper roll means for directing developer back to the reservoir means, wherein the second return duct means has the minimum dimensions required to assure adequate return of developer to the reservoir means.

19. A cartridge according to claim 18 including lip means associated with the first and second return duct means arranged to trap liquid residue flowing by gravity from the reservoir means toward the cartridge opening.

20. A cartridge according to claim 12 including sealing means for providing a liquid-tight seal in the elongated opening to prevent escape of liquid from the cartridge during storage or shipment prior to use.

21. A cartridge according to claim 12 including magnetic drive means for driving the developer pump means by magnetic coupling through a cartridge wall to an external magnetic drive means.

22. A cartridge for a liquid electrophotographic development system comprising a housing having an elongated opening for application of liquid developer to an electrophotographic member to be developed, reservoir means for holding liquid developer within the housing, sealed container means within the housing for holding toner concentrate, and toner concentrate pump means for supplying toner concentrate from the sealed container means to the developer in the reservoir means.

23. A cartridge according to claim 22 wherein the sealed container means is a flexible container.

24. A cartridge for a liquid electrophotographic development system comprising a housing, reservoir means for holding liquid developer within the housing, sealed container means within the housing for holding toner concentrate, and toner concentrate pump means for supplying toner concentrate from the sealed container means to the reservoir means, wherein the toner concentrate pump means is adapted to pump liquid developer remaining in the reservoir means into the sealed container means and retain the liquid developer therein upon termination of use of the cartridge.

25. A cartridge according to claim 24 wherein the sealed container means is a flexible container.

26. In a liquid developer supply system for supplying liquid developer uniformly to the surface of an electrophotographic member to be developed, supply duct means having a width throughout which is at least substantially equal to the width of the electrophotographic member, and fluted roll pump means arranged to pump liquid developer into the supply duct means and having a length at least substantially equal to the width of the supply duct means.

27. A sealed cartridge for use in a liquid developer system comprising a housing, reservoir means for holding liquid developer within the housing, an elongated opening in one housing wall permitting access to an electrophotographic member to be developed, removable seal means for sealing the elongated opening, a supply of untoned liquid developer in the reservoir means, sealed container means holding a supply of toner, pump means for supplying toner to the liquid developer in the reservoir means when the cartridge is in use, and magnetic drive means for driving the pump means.

28. A cartridge for use in a liquid developer system comprising a housing, reservoir means for holding liquid developer within the housing, an elongated opening in one housing wall permitting access to an electrophotographic member to be developed, sealed container means within the housing for holding liquid developer remaining upon termination of use of the cartridge, duct means for transfer of liquid developer between the reservoir means and the elongated opening, and inwardly-directed lip means in the duct means to inhibit developer residue in the reservoir means from reaching the elongated opening when the contents of the reservoir means have been transferred to the sealed container means.

* * * * *